US005230370A

United States Patent [19]

Gysin

[11] Patent Number: 5,230,370

[45] Date of Patent: Jul. 27, 1993

[54] SHAFT ROD AND A HEALD FRAME FOR A LOOM

[75] Inventor: Hansjörg Gysin, Winterthur, Switzerland

[73] Assignee: Sulzer Brothers Limited, Winterthur, Switzerland

[21] Appl. No.: 845,984

[22] Filed: Mar. 4, 1992

[30] Foreign Application Priority Data

Mar. 14, 1991 [CH] Switzerland ..... 00 775/91-7

[51] Int. Cl.[5] ..... D03C 9/06

[52] U.S. Cl. ..... 139/92; 428/902

[58] Field of Search ..... 139/91, 92; 428/116, 428/902, 284, 285

[56] References Cited

U.S. PATENT DOCUMENTS

| | | | |
|---|---|---|---|
| 4,387,742 | 6/1983 | Graf | 139/92 |
| 4,476,900 | 10/1984 | Bowen | 139/91 |
| 4,508,145 | 4/1985 | Bowen et al. | 139/92 |
| 4,633,916 | 1/1987 | Rast | 139/92 |
| 4,777,987 | 10/1988 | Asagi et al. | 139/91 |
| 4,790,357 | 12/1988 | Kramer | 139/91 |
| 4,901,767 | 2/1990 | Koch | 139/92 |
| 4,913,193 | 4/1990 | Faasse | 139/91 |
| 4,913,194 | 4/1990 | Kramer | 139/91 |

FOREIGN PATENT DOCUMENTS

| | | | |
|---|---|---|---|
| 2156331 | 7/1987 | Japan | 139/91 |
| 2068331 | 3/1990 | Japan | 139/91 |

*Primary Examiner*—Andrew M. Falik

*Attorney, Agent, or Firm*—Townsend and Townsend, Khourie and Crew

[57] ABSTRACT

A flat, lightweight shaft rod of a heald frame for a loom, is constructed as a sandwich having a light sandwich core (15) and, connected thereto, covering layers (16) made of a thermoplastics composite having industrial endless fiber reinforcements. A rigid longitudinal reinforcement member (17) is disposed on the outside of the shaft rod and a carrier bar (18) on the inside thereof, the reinforcement (17) and bar (18) both being rigidly connected mechanically to the covering layer (16).

29 Claims, 4 Drawing Sheets

SHAFT ROD AND A HEALD FRAME FOR A LOOM

BACKGROUND OF THE INVENTION

The invention relates to a shaft rod of a heald frame for a loom, the rod containing fiber composites and being flat, and to a heald frame having such rods and to a process for the production thereof.

The heald frames and shaft rods of modern looms must be able to withstand severe mechanical stressing. They have therefore conventionally been made of metal, steel being preferred for large cloth widths while aluminum is becoming increasingly popular for high-speed looms. The shaft rods are elaborate combinations of a large number of parts and are therefore relatively costly to produce. Also, they still have relatively high inertial masses, something which is increasingly causing problems in the light of high and increasing loom speeds. Heald frames containing thermoset composite parts are known. However, their production is still excessively elaborate and costly, their construction is complex, and there are problems with them in long-term operation.

SUMMARY OF THE INVENTION

It is therefore the object of this invention to obviate these disadvantages and to provide improved shaft rods, and heald frames on which the former are used, and a method of producing such rods. The same are required to be of simple construction, of reduced cost and capable of being produced rapidly, to have a reduced number of parts, low masses and/or increased stiffnesses and to have long working lives.

The problems are solved according to the invention with a novel structure combined with novel composites and their arrangement to provide improved mechanical properties and considerable simplifications and cost reductions. Basically, high strength and rigidity combined with reduced weight are achieved in a very simple way by a combination of a sandwich structure with carrying and very rigid reinforcements on both sides at the flat ends of the section bar—i.e., by the external longitudinal reinforcement and the internal carrier bar, the latter carrying the healds and also being rigidly incorporated mechanically in the shaft rod. The sandwich with its light core and strong covering layers is effective as a lightweight and stable spacing device between these terminal longitudinal reinforcements. To this end, the outer longitudinal reinforcement and the inner carrier bar are each rigidly connected to the covering layer mechanically. Also, the thermoplastics matrix in the composite improves the endurance limit and notch strength of the rods and frame. The sandwich construction increases flexural strength, provides substantial vibration damping and thus helps to reduce noise considerably.

A large-area connection between the carrier bar and the covering layer provides a very advantageous and simple transmission of forces, the height of the connecting area being, with advantage, at least as great as the thickness of the carrier bar. Appropriate low-cost carrier bar constructions can be devised from a steel section member or a sheet steel section member. The longitudinal reinforcement can be embodied by steel or aluminum sections or sheet steel sections too. Very light and rigid constructions can be provided by UD reinforcing fibers. Light and low-cost covering layers can contain at least 50% glass fibers and ±45% glass fiber laminate. Polyphenylene sulfide ("PPS"), polyether imide ("PEI"), polyamide ("PA"), polyether sulfon ("PES"), polysulfone ("PSU"), polyurethane ("PUR") or polyethylene ("PE") are suitable matrix materials for the sandwich core and covering layer. The matrixes of the sandwich core and covering layer can be interconnected amorphously or stuck together. Very simple and strong connections can be provided by welding the sandwich core and covering layer together. Appropriate light and durable sandwich cores can be made of foam substance or of a knitted fabric or of a three-dimensional network. Very good rigidity is achieved by flat transition zones between, on the one hand, the covering layer and, on the other hand, the longitudinal reinforcement and the carrier bar. Advantageously, their angles of inclination are at most 40°. Forces can be introduced satisfactorily into connecting parts if the sandwich core is compressed to form a compact material or if polymer is injected into the core at some places.

Heald frames which are stable and of very simple construction are made with identical, symmetrically arranged top and bottom shaft rods.

DESCRIPTION OF THE PREFERRED EMBODIMENTS

Figure 1:
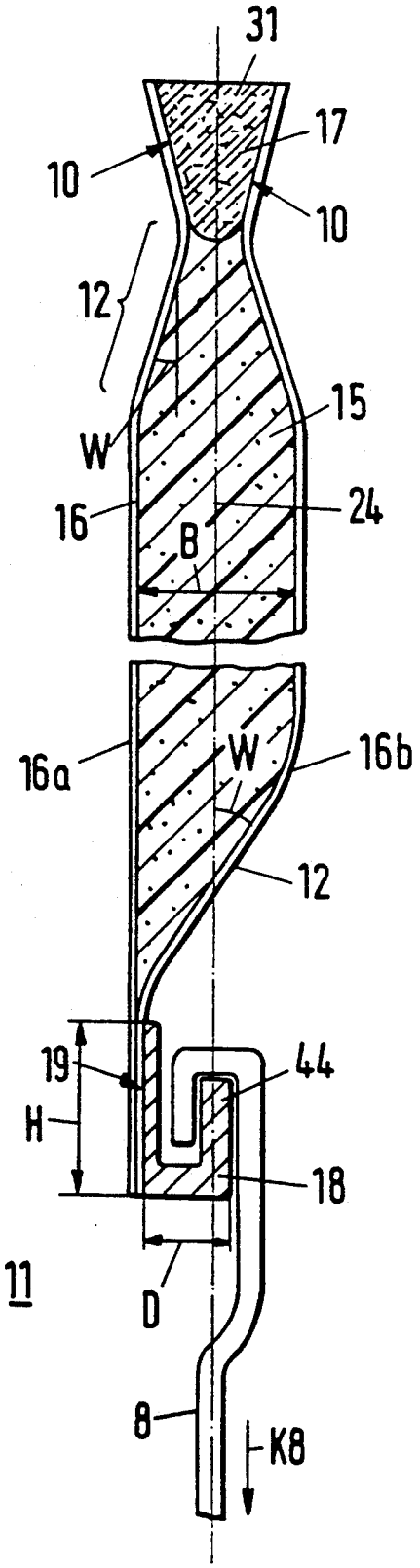
FIG. 1 is a view in section of a shaft rod according to the invention which has a sandwich structure and terminal longitudinal carriers.
Figure 8:
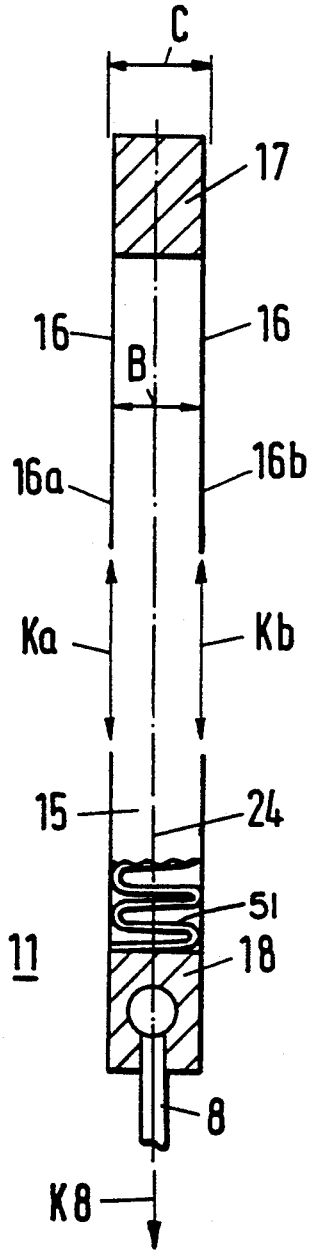
FIG. 8 shows, in section, a shaft rod constructed according to the invention.

The basic construction of a shaft rod according to the invention is schematically shown in FIG. 8 and an embodiment is shown in FIG. 1. In contrast to conventional shaft rods a shaft rod 11 according to the invention has a simple integrated construction in which two carrying longitudinal reinforcements 17, 18 are disposed one at each end of the flat rod 11, there being provided an outer longitudinal reinforcement 17 and an inner carrying bar 18, the latter carrying the healds 8 and therefore receiving the heald tensions K8 (see also FIG. 9). These longitudinal carriers 17, 18 cooperate with a sandwich core or part 15, 16 disposed between them to form a very light carrying structure which is very strong and has considerable flexural strength in respect of the heald tensions K8. The sandwich part 15 comprises a light core 15 and light thin mechanically strong and rigid covering layers 16 and **16*a*, 16*b* made of a thermoplastic composite having industrial endless fibers, the core 15 being effective as a spacer and transmitting or receiving the forces Ka, Kb between the carriers 17 and 18. If the sandwich has a relatively large width B sufficient to occupy substantially completely the shaft pitch C—i.e., the space available for a heald frame—high flexural strength in respect of twisting moments produced by other forces is provided, so that vibrations are reduced or suppressed. There is therefore a considerable noise reduction. The novel construction enables the direction of the heald tensions K8 to be displaced into the center plane 24 of the rod section and thus to reduce twisting forces. The mechanically rigid connection of the longitudinal carriers 17, 18 to the covering layer 16** of the sandwich is of considerable importance. Very light and rigid covering layers can have, for example, a layer thickness of only 0.3 to 0.6 mm.

In the embodiment of FIG. 1 the longitudinal reinforcement is in the form of a unidirectional ("UD") section 31. This section, which has high specific strength and rigidity, is made of unidirectional carbon fibers or glass fibers embedded in a thermoplastic matrix. A very satisfactory connection is obtained by way of the connecting surface 10 between the longitudinal reinforcement 17 and the covering layer 16 if both latter elements have the same matrix material and the same is welded thermoplastically to the connecting surface 10. Also, connections of this kind are simple and quick to make. On the inside of the section a steel section 44 serving as carrier bar 18 for the healds 8 is mechanically rigidly connected to the covering layer 16. The latter connection can be made with threaded bolts or rivets, for example. Very advantageously, however, large-area connections are effected by bonding or welding or a thermal fusion between the thermoplastically deformable materials in the nature of thermoplastic soldering. The steel section 44 is formed to generate a relatively large connecting area 19. Advantageously, the height H thereof is greater than carrier bar thickness D. To simplify the suspension of the healds 8 on the bar 18 and to shift the heald forces K8 into the shaft rod center-plane 24, one covering layer **16*b* is formed with a shallow bend in a transition zone 12 between the center of the shaft rod and the inside. For adaptation to the unidirectional longitudinal reinforcement 31 the covering layer is also given a shallow bend on both sides (16*a* and 16*b*) in a transition zone 12**. These transition zones have relatively small angles W which are preferably at most 40°. At the connection of the covering layers to the carrier bar the inside surfaces of said layers are joined directly to one another in a substantially planer configuration. The covering layers also end at this connection to define the inside of the shaft rod.

The sandwich core consists, for example, of light solid foam substances, knitted fabrics or three-dimensional networks 51 formed with voids. The core 15 is also intimately connected mechanically to the covering layer. Sandwich structures in which the covering layer 16 and core 15 are made of the same matrix material and are welded together are advantageous.

A sandwich structure made according to the invention can comprise, for example:

a 3-dimensional knitted fabric 51 as spacing fabric with integrated dense covering layers of glass in a polyamide (PA) matrix;

a polyetherimide (PEI) foam as a core connected to polysulfone (PSV) glass fiber covering layers, and a PEI foam having PEI glass covering layers.

Other cores can be made of polyethersulfone (PES) or polyurethane (PUR) or polyethelene (PE) foam and other covering layers can have, for example, a PE matrix or carbon fiber reinforcement.

Figure 2:
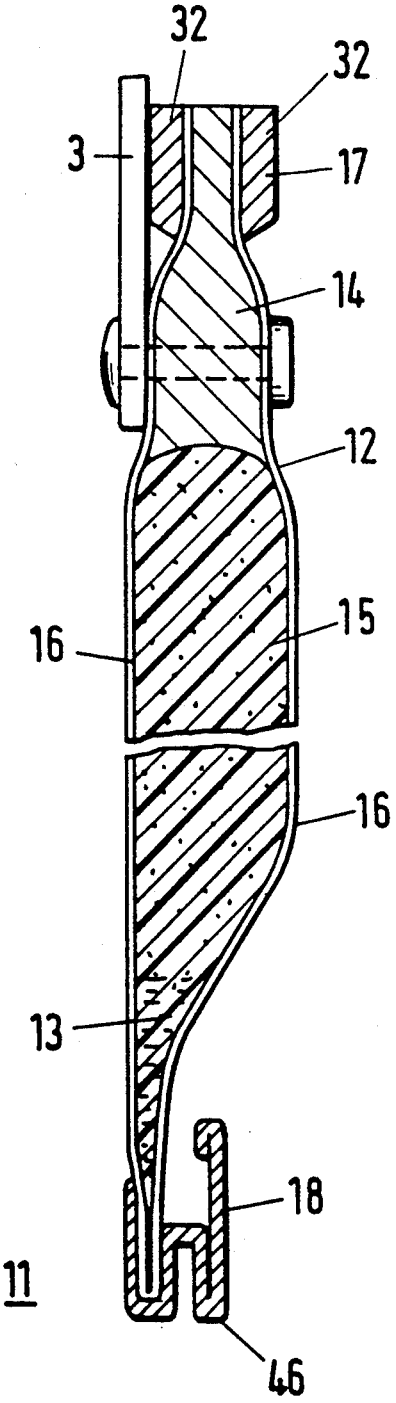
FIGS. 2 and 3 show, in section, other examples of shaft rods.

FIG. 2 shows a sandwich shaft rod having a two-part longitudinal reinforcement 17 in the form of unidirectional sections 32 and, as heald-carrying bar 18, a sheet steel section 46 which is simple to shape and inexpensive. Another advantage of the sandwich rods according to the invention is the possibility of simple production of connecting parts for connecting elements such as guide elements 4 and actuating elements 3 which ensure that forces are applied advantageously to the sandwich or its covering layer 16. To this end, a polymer material can simply be injected into the core so that a connecting part 14 for an actuating element 3 is formed (see also FIGS. 9 and 10).

On the inside of the section near the bar 18 another connecting or reinforcing zone 13 is formed by thermoplastic compression of the foam core 15.

Figure 3:
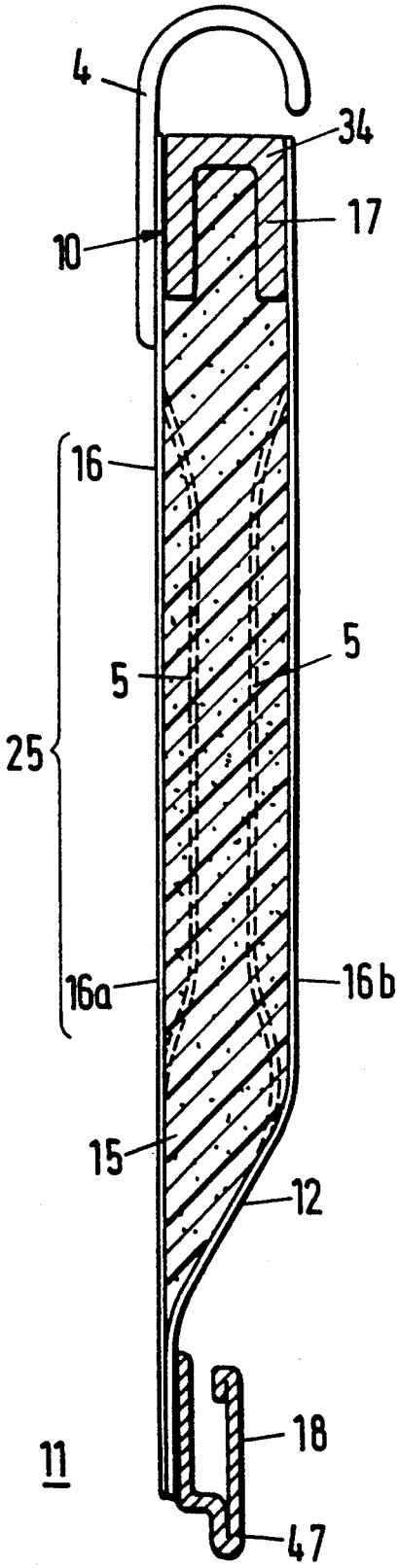

In the example shown in FIG. 3 a connection zone 5 is formed by thermoplastic reshaping and compacting of the rod cross-section in the central zone 25 of the rod cross-section, such zone receiving the connection to the side supports 2 of a heald frame, as will be described in greater detail with reference to FIGS. 9 and 11. In FIG. 3 the longitudinal reinforcement 17 is bonded in between the covering layers **16*a*, 16*b* as a steel section 34 and is configured to eliminate the need for a curved transition zone on the outside of the section. All that is necessary is a transition zone 12 on the inside of shallow curvature between one covering layer 16*b* and the bar 18. The bar 18 is another example of a sheet-steel section 47. A rod-guiding element 4 is bonded to the covering layer 16 on the outside of the rod, the steel section 34** acting in this case as a reinforcing support.

Figure 4:
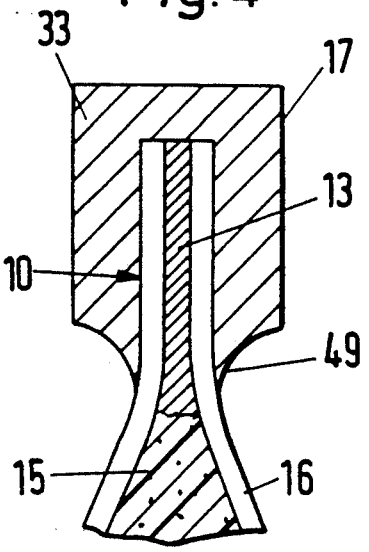
FIGS. 4 to 7 are fragmentary views, in section, of examples of longitudinal reinforcements of the shaft rod.
Figure 5:
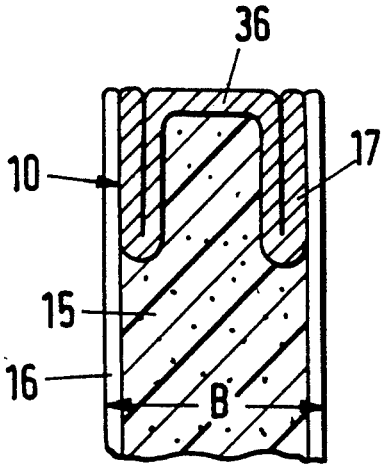
Figure 6:
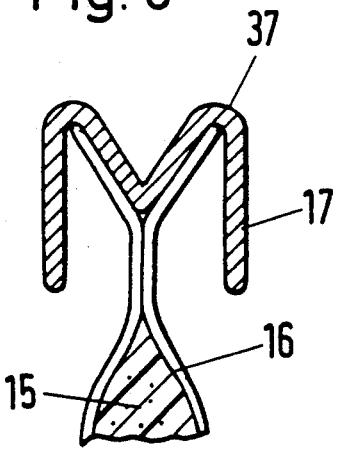
Figure 7:
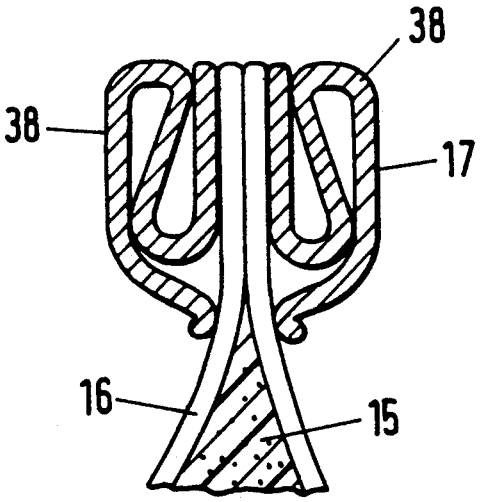

Other appropriate embodiments of the longitudinal reinforcement 17 are shown by way of example in FIGS. 4 to 7. FIG. 4 shows a UD section 33 welded on both sides to the covering layer 16, the intermediate sandwich core 15 being compacted as indicated by reference 13. The run-out shape 49 of the UD section 33 provides a very advantageous continuous transmission of forces to the sandwich structure. FIGS. 5 to 7 show other examples of low-cost sheet steel sections 36–38 which have plane covering layers in the case of the section 36 and welded covering layers 16 in the case of the very simple section 37 and of the two-part section 38.

Figure 9:
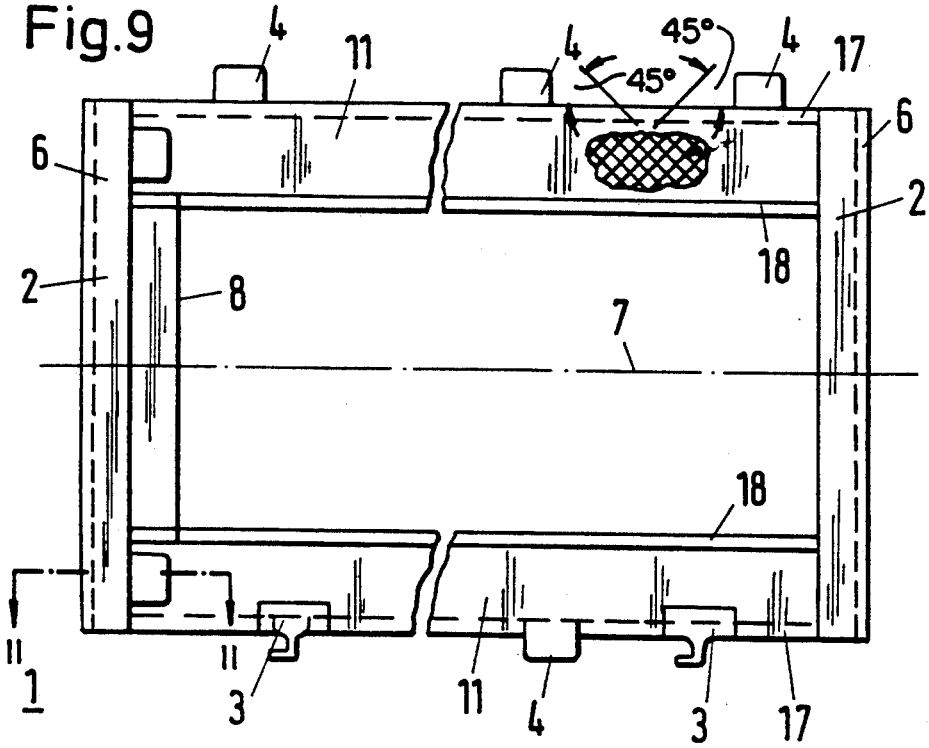
FIG. 9 shows a heald frame constructed according to the invention which has a top and bottom shaft rod.

FIG. 9 shows a heald frame 1 having a top and bottom shaft rod 11 according to the invention. Heald frames having identical shaft rods arranged symmetrically of the frame center 7 are particularly simple to manufacture. The frame has side supports 2 having guide sections 6, actuating elements 3 and top and bottom guide elements 4.

Figure 10:
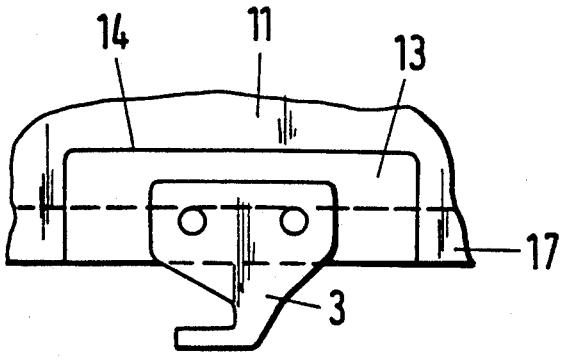
FIG. 10 is a fragmentary view which shows a connecting part with an actuating element.

The partial view of FIG. 10 shows the shape of a transition zone 14 made of compact polymer material injected into the foam core 15. The actuating element 3 is secured releasably, for example, with screws or it is secured by bonding (cf. FIG. 2).

Figure 11:
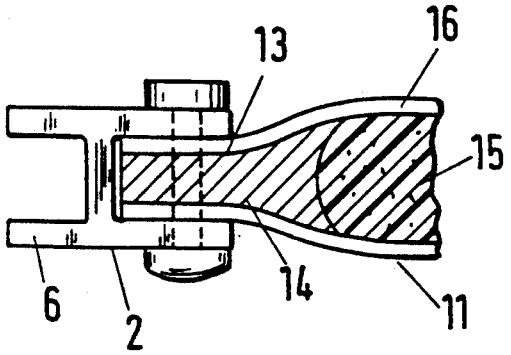
FIG. 11 is a fragmentary view, in section, taken along line 11—11 of FIG. 9 and shows a connection zone leading to the side supports of the heald frame.

FIG. 11 shows a connection of shaft rods 11 to side supports 2. A connection zone 5 (FIG. 3) in the central zone of the rod 11 is formed by a thermoplastics reduction of the layer 16 and by compacting 13 of the sandwich core 15 which can, if required, be additionally filled with polymer material to form a compact layer 14. The side supports 2 can also be made of a thermoplastics composite material having extra-strong industrial fibers. In this event one side support can be rigidly welded to the shaft rods while the second side support is connected releasably to enable the healds to be threaded.

What is claimed is:

1. A shaft rod for use on a heald frame of a loom, the shaft rod comprising an elongated, rigid reinforcement member defining an outside of the shaft rod; a carrier bar for supporting heddles bar spaced from the reinforcement member and defining an inside of the shaft rod; a sandwich structure connecting the reinforcement member and the carrier bar, the structure including a sandwich core constructed of a lightweight material, a covering layer constructed of a fiber-reinforced thermoplastic material applied to each side of the sandwich core, and means rigidly securing the covering layers to the sides of the core; and means mechanically rigidly connecting the covering layers to the reinforcement member and the carrier bar wherein the inside surface of the covering layers are connected directly to one another at the mechanical connection of the covering layers to the carrier bar, with said joined layers ending in a substantially planer configuration which defines said inside of the shaft rod.

2. A shaft rod according to claim 1 wherein the carrier bar has a connecting surface and a portion of the covering layers overlaps the connecting surface.

3. A shaft rod according to claim 2 wherein the connecting surface has height H in a direction perpendicular to a longitudinal direction of the carrier bar and a thickness D in a direction perpendicular to the connecting surface, and wherein H at least equals D.

4. A shaft rod according to claim 1 wherein the carrier bar comprises a steel section.

5. A shaft rod according to claim 4 wherein the carrier bar comprises a sheet steel section.

6. A shaft rod according to claim 1 wherein the reinforcement member comprises a steel section.

7. A shaft rod according to claim 1 wherein the reinforcement member comprises an aluminum section.

8. A shaft rod according to claim 6 wherein the reinforcement member comprises a sheet steel section.

9. A shaft rod according to claim 1 wherein the reinforcement member includes unidirectional reinforcing fibers selected from the group consisting of carbon fibers and glass fibers.

10. A shaft rod according to claim 1 wherein the covering layers each include glass fibers comprising at least 50% of the weight of the covering layer.

11. A shaft rod according to claim 10 wherein the covering layer comprises glass fibers oriented at 45° relative to a longitudinal direction of the reinforcement member.

12. A shaft rod according to claim 1 wherein at least one of the sandwich core and the covering layers comprises a plastic material selected from the group consisting of polyphenylene sulfide, polyether imide, polyamide, polyether sulfon, polysulfone, polyurethane and polyethylene.

13. A shaft rod according to claim 1 wherein the means securing the sandwich core to the covering layers comprises a bonding agents.

14. A shaft rod according to claim 1 wherein the means securing the sandwich core to the covering layers comprises a weld connecting the core and the layers.

15. A shaft rod according to claim 14 wherein the sandwich core and the covering layers are constructed of different thermoplastic materials, and wherein the means for securing the core to the layers comprises a thermal fusion between the core and the layers.

16. A shaft rod according to claim 1 wherein the sandwich core comprises a foam structure.

17. A shaft rod according to claim 1 wherein the sandwich core is constructed of a three-dimensional, thermoplastic resin impregnated structure.

18. A shaft rod according to claim 17 wherein the resin impregnated structure comprises a knitted fabric.

19. A shaft rod according to claim 17 wherein the resin impregnated structure comprises three-dimensionally arranged support members disposed between the covering layers and embedded in thermoplastic material.

20. A shaft rod according to claim 1 wherein the covering layer includes first and second edge strips for connection to the reinforcement member and the carrier bar, respectively, and including a transition zone between at least one of the edge strips and a remainder of the covering layer, the transition zone being flat and angularly inclined relative to the remainder of the covering layer.

21. A shaft rod according to claim 20 wherein the transition zone has an angular inclination relative to the remainder of the covering layer of no more than 40°.

22. A shaft rod according to claim 1 including a connection section defined by the sandwich structure for connecting a part to the shaft rod, the connection section including a portion of the sandwich core which has a greater density than a remainder of the core section and a correspondingly reduced thickness for receiving said part.

23. A shaft rod according to claim 1 including reinforced areas defined by surface portions of the covering layers overlying the sandwich core, and including a volume of a compact polymer disposed in a space intermediate the covering layers and beneath said covering layer surface portions, the compact polymer being contiguous with the covering layer to thereby form the reinforced areas for attaching parts to the shaft rod.

24. A shaft rod according to claim 1 including connection zones defined by thermoplastically deformed portions of the covering layers for securing lateral supports to the shaft rod, the zones being disposed along edges of the covering layers extending from the reinforcement member to the carrier bar.

25. A substantially flat shaft rod for use on a heald frame of a loom, the shaft rod comprising an elongated, substantially linear, rigid reinforcement member defining an outside of the shaft rod; an elongated carrier bar for supporting heddles spaced from and disposed in a common plane with the reinforcement member and defining an inside of the shaft rod; a sandwich structure disposed between the member and the bar and including a lightweight sandwich core made of a thermoplastic material and having spaced-apart oppositely directed flat faces disposed between the member and the bar, and a covering layer constructed of a fiber-reinforced thermoplastic material rigidly secured to each face of the core, the layers including edge portions which overlap the reinforcement member and the carrier bar; first means for rigidly connecting an edge portion of the covering layers to the reinforcement member and the carrier bar; and second means for rigidly connecting inside surfaces of said edge portions of the covering layers directly to each other at said carrier bar connection, with said joined edge portions ending in a substantially planer configuration which defines the inside of the shaft rod.

26. A substantially flat shaft rod for use on a heald frame on a loom, the shaft rod comprising an elongated, substantially linear, rigid reinforcement member defining an outside of the shaft rod and having a connecting surface; and elongated carrier bar for supporting heddles spaced from the disposed in a common plane with the reinforcement member defining an inside of the shaft rod and having a connecting surface; a substantially planar sandwich structure interconnecting the member and the bar, the structure including a lightweight sandwich core constructed of a thermoplastic material and defining spaced-apart, oppositely directed core faces, and a covering layer constructed of a fiber-reinforced thermoplastic material rigidly secured to each face of the sandwich core and having edge portions overlapping connecting surfaces of the reinforcement member and the carrier bar, the thermoplastic material of the sandwich core and the covering layers being selected from the group consisting of polyphenylene sulfide, polyether imide, polyamide, polyether sulfon, polysulfone, polyurethane or polyethylene; and means for rigidly connecting the edge portions of the covering layers to the reinforcement member and the carrier bar, respectively, along their connecting surfaces wherein inside surfaces of the edge portions are connected directly to one another with said joined edge portions ending in a substantially planer configuration which defines said inside of the shaft rod.

27. A heald frame for a loom, the frame comprising first and second, spaced-apart shaft rods, each shaft rod including an elongated, rigid reinforcement member defining an outside of the shaft rod; a carrier bar spaced from the reinforcement member and defining an inside of the shaft rod; a sandwich structure connecting the reinforcement member and the carrier bar, the structure including a sandwich core constructed of a lightweight material, a covering layer constructed of a fiber-reinforced thermoplastic material applied to each side of the sandwich core, and means rigidly securing the covering layers to the sides of the core; and means mechanically rigidly connecting the covering layers to the reinforcement member and the carrier bar wherein the inside surface of the covering layers are connected directly to one another at the mechanical connection of the covering layers to the carrier bar, with said joined layers ending in a substantially planer configuration which defines said inside of the shaft rod.

28. A heald frame according to claim 27 wherein the first and second shaft rods are identically constructed and arranged symmetrically about a center line of the heald frame which is parallel to the reinforcement member.

29. A heald frame according to claim 27 wherein the means connecting the shaft rods comprise first and second lateral supports constructed of a fiber-reinforced thermoplastic material and secured to the sandwich structure.

* * * * *